US006530864B1

(12) United States Patent
Parks

(10) Patent No.: US 6,530,864 B1
(45) Date of Patent: Mar. 11, 2003

(54) APPARATUS FOR REMOVABLY INTERFACING A BICYCLE TO A COMPUTER

(76) Inventor: Edward H. Parks, 920 S. Corona St., Denver, CO (US) 80209

( * ) Notice: Subject to any disclaimer, the term of this patent is extended or adjusted under 35 U.S.C. 154(b) by 105 days.

(21) Appl. No.: 09/679,193

(22) Filed: Oct. 3, 2000

Related U.S. Application Data

(63) Continuation-in-part of application No. 09/305,124, filed on May 4, 1999, now Pat. No. 6,126,571.

(51) Int. Cl.[7] ..... A63B 21/005
(52) U.S. Cl. ..... 482/4; 482/57; 482/61
(58) Field of Search ..... 482/1–9, 51, 57, 482/61–65, 900–902

(56) References Cited

U.S. PATENT DOCUMENTS

| | | | | |
|---|---|---|---|---|
| 4,512,567 A | | 4/1985 | Phillips | |
| 4,542,897 A | | 9/1985 | Melton et al. | |
| 4,637,605 A | | 1/1987 | Ritchie | |
| 4,709,917 A | | 12/1987 | Yang | |
| 4,938,475 A | * | 7/1990 | Sargeant et al. | 482/9 |
| 4,976,435 A | | 12/1990 | Shatford et al. | |
| 5,240,417 A | | 8/1993 | Smithson et al. | |
| 5,362,069 A | | 11/1994 | Hall-Tipping | |
| 5,364,271 A | * | 11/1994 | Aknin et al. | 434/61 |
| 5,466,200 A | | 11/1995 | Ulrich et al. | |
| 5,547,439 A | | 8/1996 | Rawls et al. | |
| 5,591,104 A | | 1/1997 | Andrus et al. | |
| 5,645,513 A | | 7/1997 | Haydocy et al. | |
| 5,785,630 A | | 7/1998 | Bobick et al. | |
| 5,839,990 A | | 11/1998 | Virkkala | |
| 6,142,913 A | * | 11/2000 | Ewert | 482/8 |

* cited by examiner

*Primary Examiner*—Glenn E. Richman
(74) *Attorney, Agent, or Firm*—Dorr, Carson, Sloan & Birney, P.C.

(57) ABSTRACT

An apparatus enables a conventional bicycle to be interfaced to a computer to serve as a controller for electronic games and the like. The apparatus includes a rear wheel support that removably holds the bicycle in an upright position while allowing rotation of the rear wheel. A rear wheel sensor detects rotation of the rear wheel of the bicycle as the rider pedals and generates an electrical signal indicating the rotational speed of the rear wheel. The apparatus also includes a front wheel sensor that detects the direction of the front wheel of the bicycle for the computer through the computer interface. For example, the front wheel of the bicycle can be removably supported by a front support member that rotates about a vertical axis as the front wheel is turned by the handle bars. A potentiometer is used to measure rotation of the front support member, and therefore the direction of the front wheel of the bicycle.

19 Claims, 5 Drawing Sheets

APPARATUS FOR REMOVABLY INTERFACING A BICYCLE TO A COMPUTER

RELATED APPLICATION

The present application is a continuation-in-part of the Applicant's U.S. patent application Ser. No. 09/305,124, filed on May 4, 1999, U.S. Pat. No. 6,126,571,

BACKGROUND OF THE INVENTION

1. Field of the Invention

The present invention relates generally to the field of control devices for computers. More specifically, the present invention discloses an apparatus for interfacing a bicycle to a computer so that it can serve as a controller for electronic games, virtual reality simulations, and the like.

2. Statement of the Problem

Exercise bikes have been used for many years. These devices typically have handlebars, pedals, and either no wheels or only one wheel. A conventional exercise bike is usually mounted to a base that supports the wheel above the ground and keeps the entire assembly stationary. The pedals connected to the exercise bike provide a degree of resistance to simulate peddling an actual bicycle. For example, in some exercise bikes, the pedals rotate a wheel in contact with a friction belt to generate resistance. Rotation of the wheel also provides a degree of visual authenticity for the rider while pedaling.

Boredom and fatigue are common complaints against using conventional exercise bikes. In response, the prior art includes many efforts to make riding an exercise bike more interesting for the rider. One approach has been to equip the exercise bike with a display (e.g., a television screen, computer display, or virtual reality goggles) to simulate an actual bicycle trip or some other adventure or game. Some of these systems allow the rider to interact with the simulation by steering with the handlebars, and controlling the simulated speed by means of the pedals and brakes. Some simulation systems also enable the computer or game controller to provide feedback to the rider by adjusting the degree of resistance to peddling according to the simulated terrain, and by changing the angle of inclination of the exercise bike to correspond to the simulated terrain.

Various types of exercise equipment and exercise bikes have also been used in the past as input devices for computers and electronic games. For example, the prior art in the field includes the following:

| Inventor | Patent No. | Issue Date |
|---|---|---|
| Virkkala | 5,839,990 | Nov. 24, 1998 |
| Bobick et al. | 5,785,630 | July 28, 1998 |
| Haydocy et al. | 5,645,513 | July 8, 1997 |
| Andrus et al. | 5,591,104 | Jan. 7, 1997 |
| Rawls et al. | 5,547,439 | Aug. 20, 1996 |
| Ulrich et al. | 5,466,200 | Nov. 14, 1995 |
| Hall-Tipping | 5,362,069 | Nov. 8, 1994 |
| Smithson et al. | 5,240,417 | Aug. 31, 1993 |
| Shatford et al. | 4,976,435 | Dec. 11 1990 |
| Yang | 4,709,917 | Dec. 1, 1987 |
| Ritchie | 4,637,605 | Jan. 20, 1987 |
| Melton et al. | 4,542,897 | Sep. 24, 1985 |
| Phillips | 4,512,567 | Apr. 23, 1985 |

Bobick et al. disclose an interactive exercise apparatus that includes an exercise mechanism, a steering mechanism, and a control mechanism for manipulation by the user. The exercise mechanism can be, for example, the steps of a stair-climbing simulator or the pedals of an exercise bike.

Rawls et al. disclose an exercise system using a plurality of exercise bikes having micro-controllers that communicate with one another. Each unit also includes a display showing indicators that move along respective paths of travel on the display simulating the travel of a plurality of cycles racing against each other.

Ulrich et al. disclose an interactive exercise apparatus having an exercise mechanism and a steering mechanism for manipulation by the user to achieve exercise and to indicate a direction of motion. A simulated environment is generated by computer and displayed for the user.

Smithson et al. disclose a system for simulating bicycle riding that incorporates a conventionally-appearing bicycle. However, the front and rear wheels are provided solely for visual authenticity. For example, the rear wheels are not driven by the pedals. Instead, the pedals drive a chain that extends downward into the base enclosure. Thus, a conventional bicycle could not be readily used in association with the system disclosed by Smithson et al.

Yang discloses an exercise bike having an electronic display for simulating road conditions.

Virkkala, Haydocy et al., Andrus et al., Hall-Tipping, Shatford et al., Ritchie, Melton et al., and Phillips also disclose examples of exercise bikes adapted for controlling a computer or video game.

The prior art discussed above are all limited to a customized exercise bike or customized exercise equipment, rather than an actual bicycle. An actual bicycle has substantial advantages in terms of added realism and familiarity for the rider. Therefore, a need exists for an interface system that enables a user to connect any conventional bicycle to a computer or electronic game, and to use the bicycle as an input device for a computer or as a control device for operation of an electronic game. Ideally, such an interface system should not require substantial modifications to the bicycle.

3. Solution to the Problem

None of the prior art references discussed above enable a conventional bicycle to be used as an input device or controller for a computer or an electronic game. In contrast, the present invention permits virtually any conventional bicycle to be quickly and easily adapted to a computer or electronic game without modifications to the bicycle. For example, in a family with people of different sizes and abilities, the present invention allows each family member to connect their own bicycle to a computer or electronic game with minimal effort.

SUMMARY OF THE INVENTION

This invention provides an apparatus that enables a bicycle to be interfaced to a computer to serve as a controller for electronic games and the like. The apparatus includes a rear wheel support that removably holds the bicycle in an upright position while allowing rotation of the rear wheel. A rear wheel sensor detects rotation of the rear wheel of the bicycle as the rider pedals and generates an electrical signal indicating the rotational speed of the rear wheel. The apparatus also includes a front wheel sensor that detects the direction of the front wheel of the bicycle for the computer interface. For example, the front wheel of the bicycle can be removably supported by a front support member that rotates about a vertical axis as the front wheel is turned by the handle bars. A potentiometer is used to measure rotation of the front support member, and therefore the direction of the front wheel of the bicycle.

A primary object of the present invention is to provide an apparatus that enables a conventional bicycle to be used without modification as the controller for electronic games.

Another object of the present invention is to provide an apparatus that interfaces a computer to a conventional bicycle for other purposes, such as monitoring the rider's exercise patterns, virtual reality simulations, or as a general input device to the computer.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 8(*b*) is a simplified diagram corresponding to FIG. 8(*a*) showing the resulting resistance when the left hand-grip lever is actuated by the rider to steer to the left.

FIG. 8(*c*) is a simplified diagram corresponding to FIGS. 8(*a*) and 8(*b*) showing the resulting resistance when the right hand-grip lever is actuated by the rider to steer to the right.

DETAILED DESCRIPTION OF THE INVENTION

Figure 1:
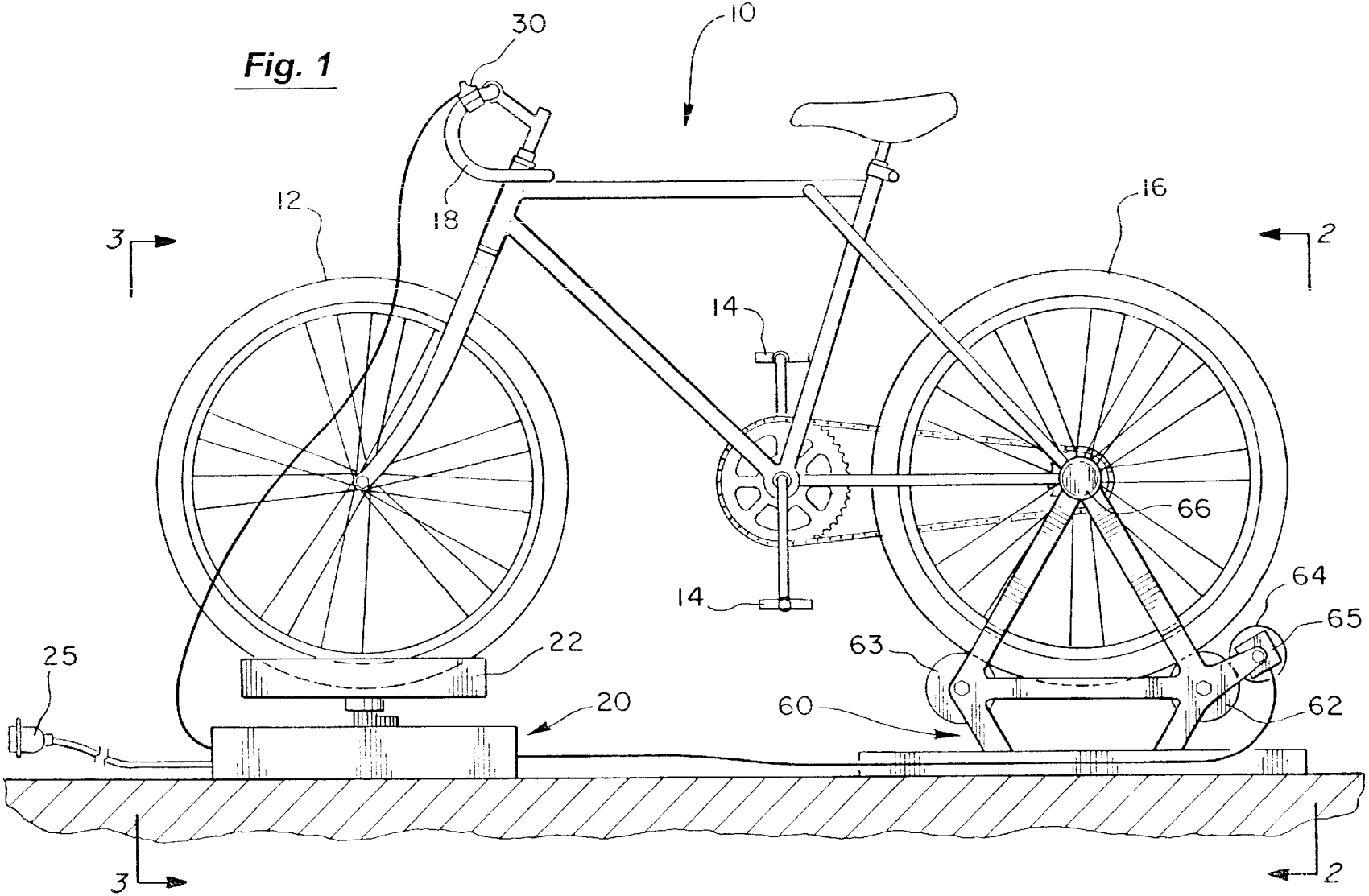
FIG. 1 is a side elevational view of a bicycle 10 attached to the present invention.

Turning to FIG. 1, a side elevational view is provided showing a conventional bicycle 10 attached to the present invention. The bicycle 10 generally includes a front wheel 12 and a rear wheel 16. A rider can sit on the bicycle seat and crank the pedals 14 to drive the rear wheel 16 via the bicycle chain and gears. The rider can also steer the front wheel 12 by manually turning the handlebars 18.

Figure 3:
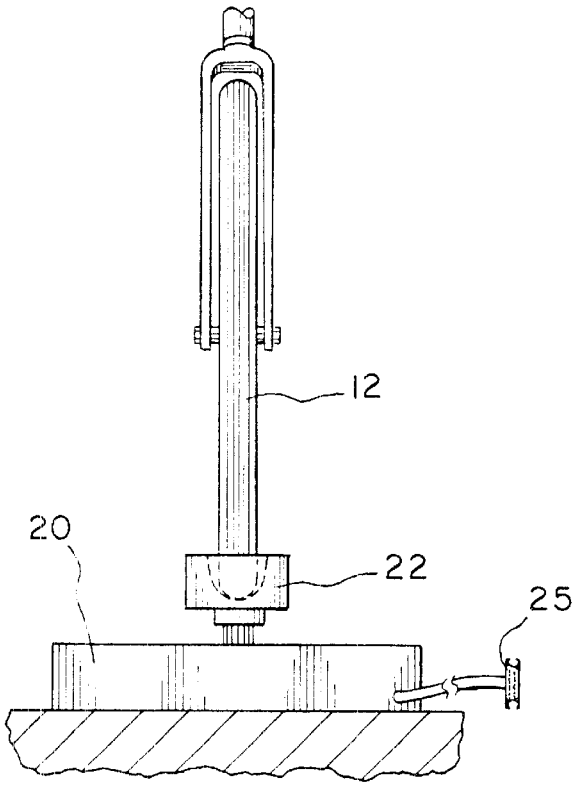
FIG. 3 is a detail front view of the front wheel support 20 corresponding to FIG. 1.
Figure 4:
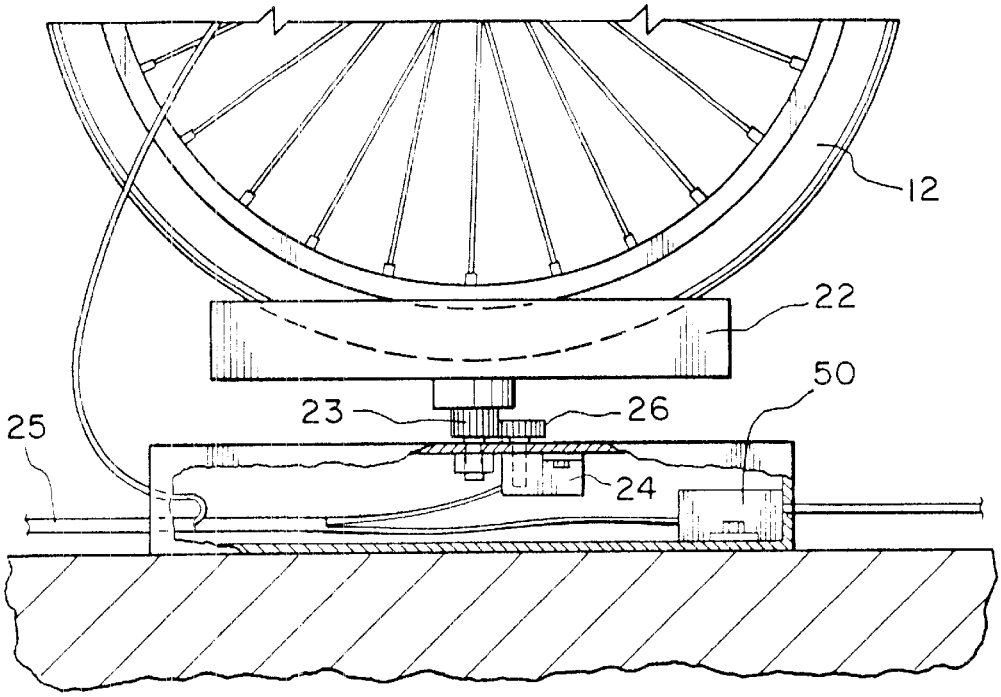
FIG. 4 is a detail side elevational view of the front wheel support 20 showing the base in cross-section.

The front wheel 12 of the bicycle 10 is removably engaged and supported by a front wheel support 20, as shown in FIG. 1. The front wheel support 20 includes an front support member 22 that engages and supports the front wheel 12, and allows rotation about a vertical axis as the front wheel 12 is turned by the handlebars 18. For example, the lower portion of the front wheel 12 can be held in a narrow trough or slot in the front support member 22. FIG. 3 is a corresponding detail front view and FIG. 4 is a detail side elevational view of the front wheel support 20 showing this embodiment. This approach has the advantage of simplicity, and allows the bicycle 10 to be removed from the front wheel support 20 by lifting the front wheel 12 out of the trough or slot in the front support member 22. Alternatively, the front wheel 12 of the bicycle 10 could be attached to the front support member 22 by other means, such as a clamp, clip or vise arrangement.

Rotation of the handlebars 18 and front wheel 12 causes rotation of the front support member 22 about a substantially vertical axis with respect to the base of the front wheel support 20. In particular, rotation of the front support member 22 results in rotation of a first gear 23, which turns a second gear 26 attached to a potentiometer 24. Thus, the potentiometer 24 provides a variable resistance that is a function of the direction (i.e., angular rotation) of the handlebars 18 and front wheel 12 of the bicycle 10. The gear ratio of the first and second gears 23 and 26 can be selected to provide a desired degree of sensitivity to rotation of the front wheel 12. A potentiometer 24 offers the advantages of low cost and ruggedness. In addition, the variable resistance of a potentiometer 24 can be directly interfaced to a standard game port for a personal computer or other electronic games, as will be discussed in greater detail below. However, it should be expressly understood that other types of front wheel sensors could be employed in place of a potentiometer 24 to detect the direction of the front wheel 12 of the bicycle 10. For example, the angular orientation of the front wheel 12 or the handlebars 18 could be detected by photo-detectors, electromagnetic means, or other types of electro-mechanical devices.

Figure 2:
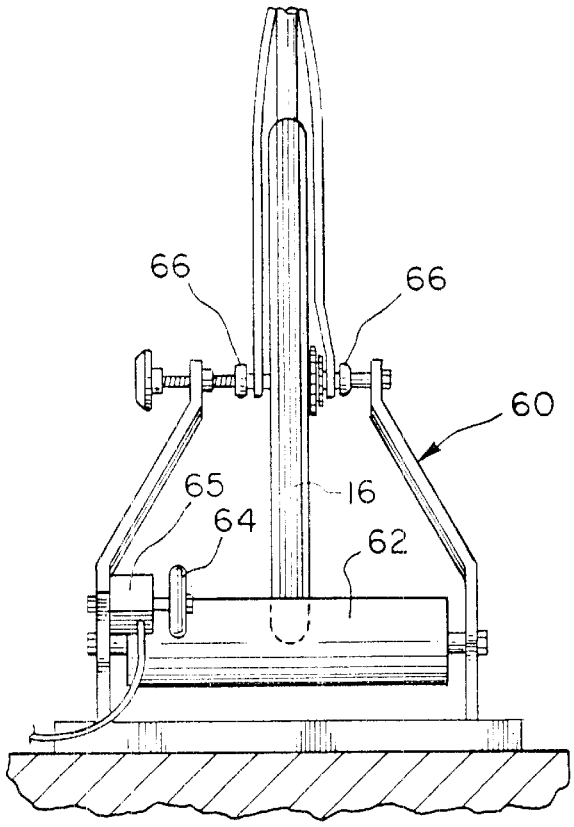
FIG. 2 is a detail rear view of the rear wheel support 60 corresponding to FIG. 1.

The rear wheel 16 of the bicycle 10 can be removably attached to a rear wheel support 60, as depicted in FIGS. 1 and 2. This rear wheel support 60 also holds the bicycle frame in an upright position while allowing rotation of the rear wheel in response to force exerted on the pedals 14 by the rider. For example, the rear wheel support 60 can include a clamp 66 that engages the bicycle frame or the hub of the rear wheel 16.

In the preferred embodiment of the present invention, the rear wheel 16 rests in contact with a number of rollers 62 and 63 that rotate as the rear wheel 16 is driven by the rider. A small electrical generator 65 mounted to the rear wheel support 60 has a drive wheel 64 in contact with one of the rollers 62 that spins the generator rotor, as illustrated in FIG. 2. In other words, the pedals 14 drive the rear wheel 16, that drives the roller 62, that drives the electrical generator 65. As a result, the output voltage of the generator 65 is an AC signal having an amplitude that is a function of the rotational speed of the rear wheel 16.

Figure 5:
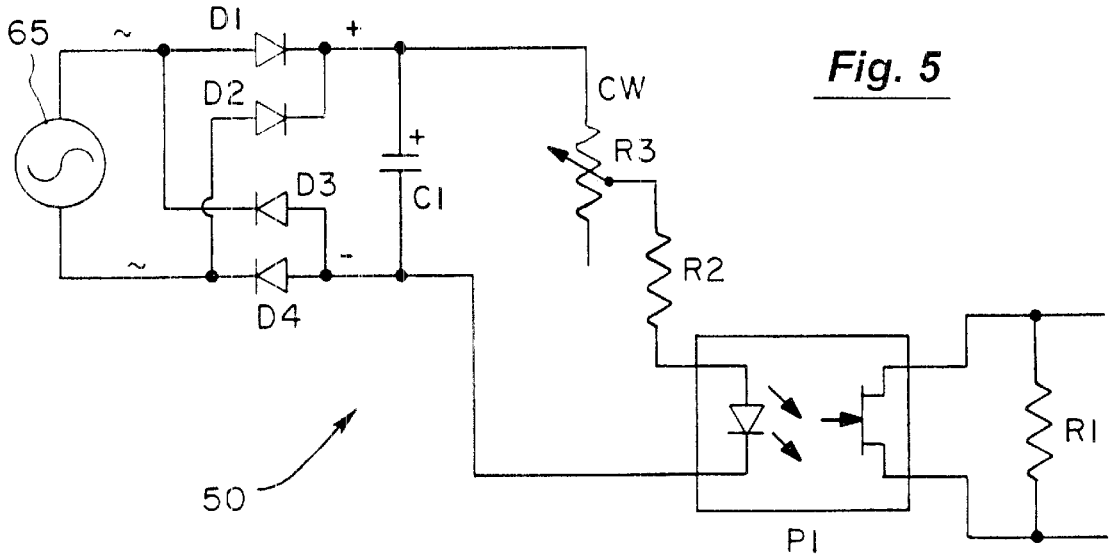
FIG. 5 is a schematic diagram of the circuit 50 used to convert the generator output voltage to a variable resistance for the computer interface.
Figure 6:
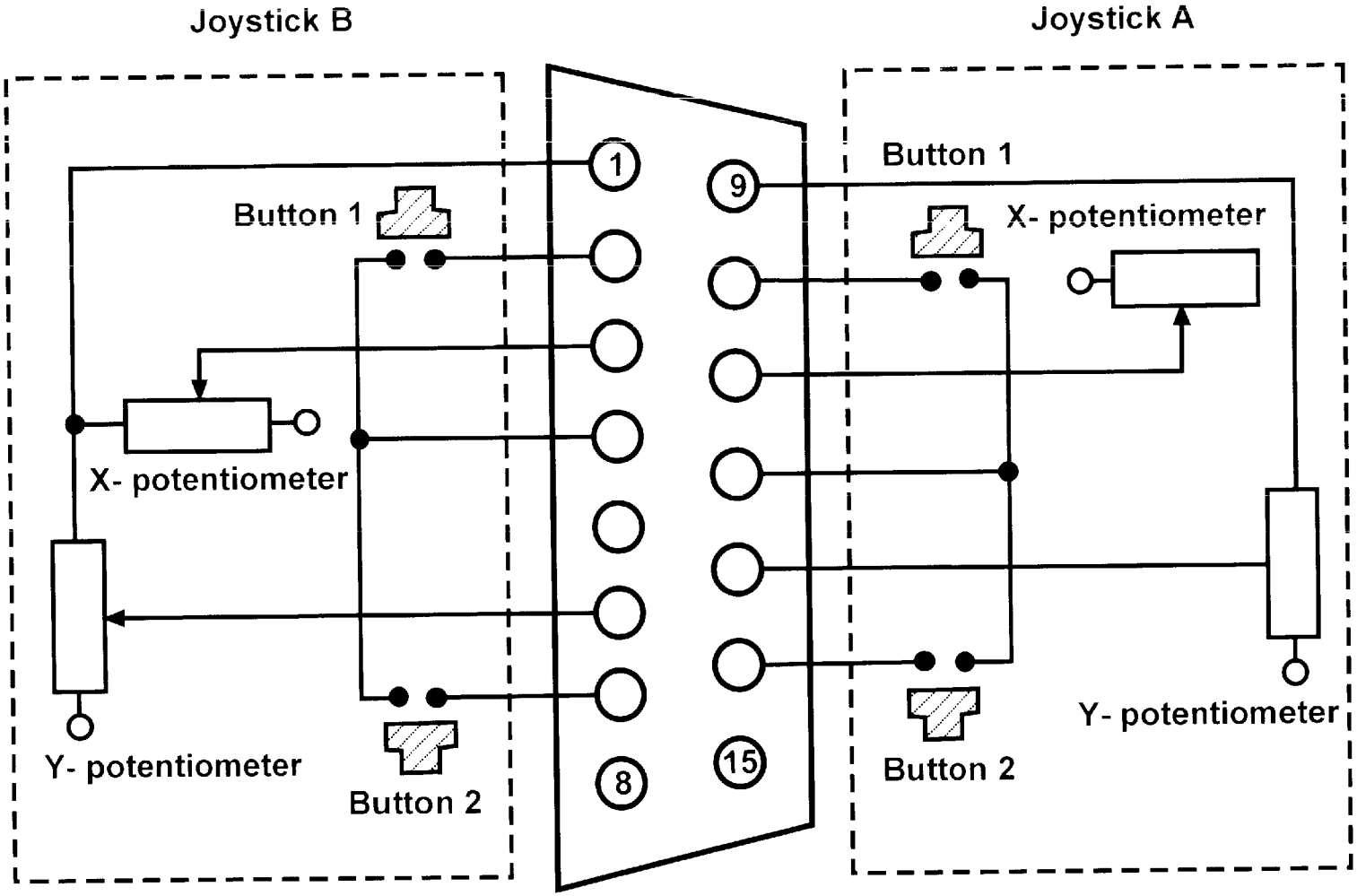
Fig. 6 (Prior Art)
FIG. 6 is a pin diagram of a conventional 15-pin game port interface for a personal computer.

The standard 15-pin game port interface for a personal computer is shown in FIG. 6. Similar interfaces are used for other electronic games. It should be noted that this type of controller interface requires a variable resistance for each control axis (i.e., the "X-potentiometer" and "Y-potentiometer" shown in FIG. 6. Therefore, the output voltage from the generator 65 must be converted into the form of a variable resistance for compatibility with the interface. This is accomplished by the generator interface circuit 50 shown in FIG. 5. The output voltage from the generator 65 is rectified by diodes D1–D4 and capacitor C1 to produce a DC voltage. The range of the DC voltage can be adjusted by variable resistor R3. The DC voltage powers a photo-coupler P1 (i.e., an LED and photo-detector) that is included to provide electrical isolation. The conductivity of the photo-detector P1 is a function of the intensity of the light emitted by the LED, which in turn is a function of the DC voltage. Therefore, the effective resistance of the combination of resistor R1 and photo-detector P1 is a function of the output voltage of the generator 65.

Other arrangements could be employed to drive the electrical generator 65. For example, the generator drive wheel could be driven directly by contact with the rear tire of the bicycle 10. It should also be understood that other types of sensors could be use in place of the electrical generator 65 to measure the rotational speed of the rear wheel 16 of the bicycle 10. For example, a photodetector can be used to detect rotation of the rear wheel or its spokes. Electromagnetic or electro-mechanical couplers could also be employed.

The combination of features discussed above results in an apparatus that is plug-compatible with the standard game port interface for personal computers and other types of electronic games shown in FIG. 6. The potentiometer 24 connected to the front wheel support 20 and the output terminals of the generator interface circuit 50 can be directly connected to substitute for the "X-potentiometer" and "Y-potentiometer" of a conventional joystick (via a standard 15-pin game port connector 25) to serve as an input device for a computer or as a controller for an electronic game. For example, the front wheel potentiometer 24 controls steering and the generator interface circuit 50 controls speed.

It should be expressly understood that the present invention is not limited to the 15-pin game port connector 25 shown in FIG. 6. Other types of connectors or other computer interfaces could be readily substituted. For example, some newer personal computers are equipped with a universal serial bus (USB) port that can be used to connect any of a variety of peripheral devices.

The basic configuration of the present invention discussed above provides a one-axis controller with speed control. This configuration can be supplemented with additional features, such as a "fire" button 30 (shown in FIG. 1) and other control switches that can be removably attached to the frame or handlebars of the bicycle 10. A second-axis controller (not shown) can be added by mounting a second potentiometer to the handlebars or frame of the bicycle for manual operation by the rider. The additional controls can also be accommodated within the standard game port interface using the pin diagram shown in FIG. 6.

Figure 7:
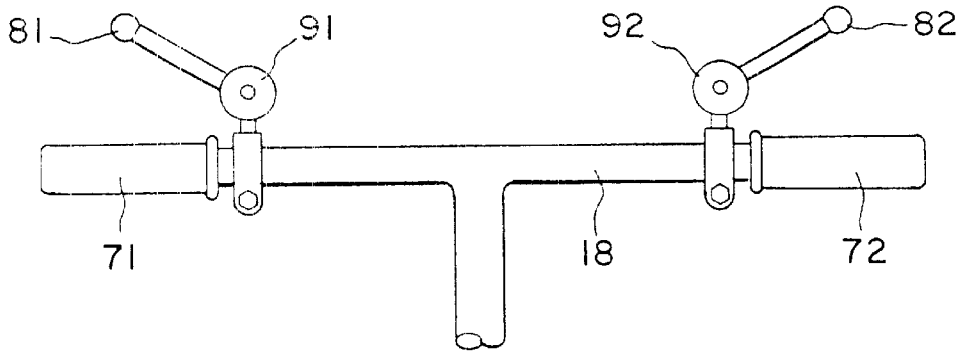
FIG. 7 is a top view of the bicycle handlebar in an alternative embodiment of the invention, in which hand-grip levers are use for steering in the simulation.
Figure 8A:
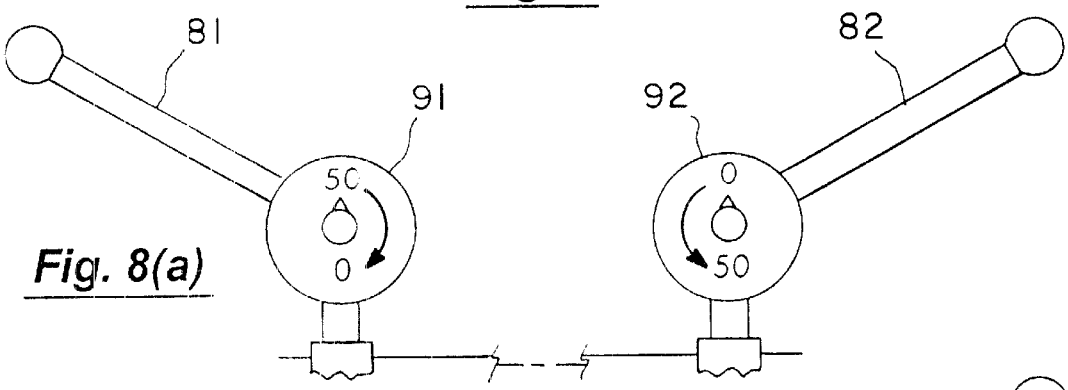
FIG. 8(*a*) is a simplified diagram of the hand-grip levers showing the resulting resistance when neither lever is actuated by the rider, so that steering is centered.
Figure 8B:
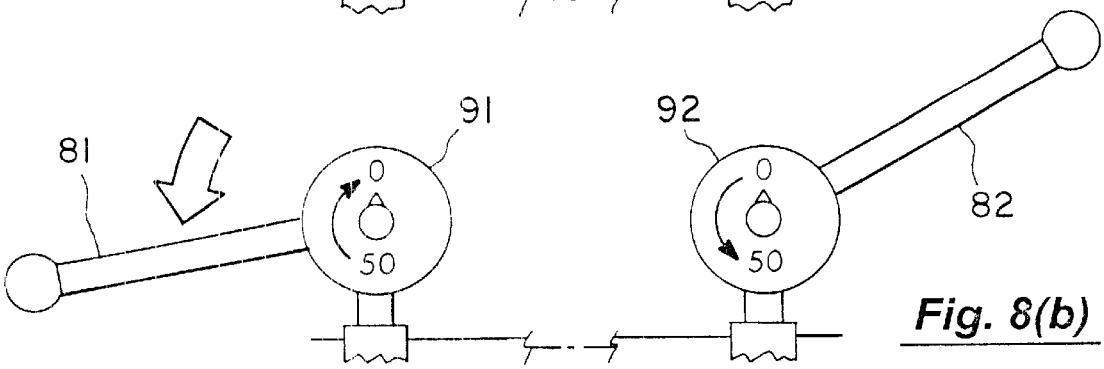
Figure 8C:
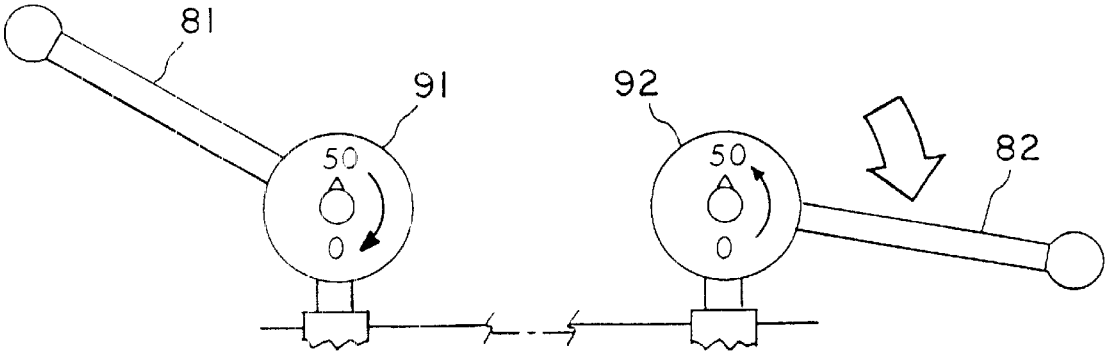

FIGS. 7 through 8(*c*) illustrate a second embodiment of the present invention in which the front support member 22 is omitted to reduce complexity and minimize manufacturing costs. In this embodiment, the front wheel of the bicycle is removably attached to a fixed front wheel support. Alternatively, the front wheel of the bicycle can be removed from the bicycle frame, and the front portion of the bicycle can be supported by a front support bracket that attaches directly to the front wheel fork.

The handlebars 18 do not turn in this embodiment, so other means must be provided to allow the rider to provide a steering input to the game port interface in place of the potentiometer 24 in FIG. 4. One possible solution is to place a removable steering input device (e.g., one or more potentiometers) on the handlebars 18 or bicycle frame to enable the rider to simulate steering.

FIG. 7 is a top view of the bicycle handlebar 18 in an embodiment in which two hand-grip levers 81 and 82 rotate corresponding potentiometers 91 and 92 for steering in the simulation. FIG. 8(*a*) shows the resulting resistance when neither lever is actuated by the rider, so that steering is centered. The left potentiometer 91 has a resistance of 50 kΩ, while the right potentiometer 92 has zero resistance. The potentiometers 91 and 92 are connected in series to the computer interface, so their total resistance is 50 kΩ.

FIG. 8(*b*) shows the resulting resistance when the left hand-grip lever 81 is actuated by the bicycle rider to steer to the left. The left lever 81 has been rotated by the rider so that the left potentiometer 91 has zero resistance. The right potentiometer 92 continues to have zero resistance, so the total resistance of both potentiometers. 91, 92 is zero.

FIG. 8(*c*) shows the resulting resistance when the right hand-grip lever 82 is actuated by the rider to steer to the right. The left potentiometer 91 has a resistance of 50 kΩ, as in FIG. 8(*a*). However, the right lever 82 has been rotated by the rider so that the right potentiometer 92 has a resistance of 50 kΩ. The total resistance of both potentiometers 91, 92 is 100 kΩ. Thus, the combination of the potentiometers 91 and 92 provides a continuous range of resistances from 0 to 100 kΩ determined by the positions of the hand-grip levers 81, 82 to directly replace the steering potentiometer 24 in FIG. 4. This range of resistance is intended merely as one example. Different types of computer game interfaces use different ranges of resistances.

The levers 81 and 82 used to rotate the potentiometer settings can be similar to conventional hand brake levers. Alternatively, the hand-grip levers 81 and 82 could be replaced with another type of lever, knob, or steering wheel that can be manually adjusted by the bicycle rider to simulate steering. The levers 81 and 82 are preferably attached to the handlebar 18 adjacent to the left and right hand grips 71 and 72, as shown in FIG. 7, for ease of use. However, the levers 81, 82 and potentiometers 91, 92 could be attached elsewhere on the handlebar or bicycle frame.

Other methods of detecting steering input and other types of steering input sensors could be employed in place of the potentiometers. For example, a pair of On-Off switches attached to the handlebar 18 could be substituted. Alternatively, photo-detectors, electromagnetic means, or other types of electro-mechanical devices could be used to provide steering input.

The above disclosure sets forth a number of embodiments of the present invention. Other arrangements or embodiments, not precisely set forth, could be practiced under the teachings of the present invention and as set forth in the following claims.

I claim:

1. An apparatus for removably connecting a bicycle to a computer, said bicycle having pedals, a rear wheel driven by said pedals, and handlebars; said computer having an interface for receiving electrical signals, said apparatus comprising:

a support for removably holding the bicycle in an upright position while allowing rotation of the rear wheel in response to force exerted on the pedals of the bicycle by a rider;

a rear wheel sensor for interface to the computer, said rear wheel sensor detecting the rotational speed of the rear wheel of the bicycle; and a steering input device interfaced to the computer and removably attachable to the bicycle.

2. The apparatus of claim 1 further comprising a control switch for removable attachment to the bicycle and for interface to the computer.

3. The apparatus of claim 1 wherein said rear wheel sensor comprises an electrical generator driven by the rear wheel of the bicycle.

4. The apparatus of claim 3 further comprising a roller for contacting and supporting the rear wheel of the bicycle, and wherein said roller is rotated by the rear wheel and said roller drives said electrical generator.

5. The apparatus of claim 1 wherein said the steering input device comprises a potentiometer.

6. The apparatus of claim 1 wherein said support comprises means for removably supporting the hub of the rear wheel of a bicycle.

7. An apparatus for removably connecting a bicycle to a computer, said bicycle having pedals, a rear wheel driven by said pedals, handlebars, and a front wheel; said computer having an interface for receiving electrical signals, said apparatus comprising:

a rear wheel support having:

(a) a support for removably holding the bicycle in an upright position while allowing rotation of the rear wheel in response to force exerted on the pedals of the bicycle by a rider; and (b) a rear wheel sensor for interface to a computer, said rear wheel sensor detecting the rotational speed of the rear wheel of the bicycle; and a front wheel support; and a steering input device interfaced to the computer and removably attachable to the bicycle.

8. The apparatus of claim 7 wherein the front support member further comprises a slot for removably engaging a lower portion of the front wheel of the bicycle.

9. The apparatus of claim 7 wherein the steering input device comprises a potentiometer.

10. The apparatus of claim 7 wherein said rear wheel sensor comprises an electrical generator driven by the rear wheel.

11. The apparatus of claim 9 wherein said rear wheel support further comprises a roller for contacting and supporting the rear wheel of the bicycle, and wherein said roller is rotated by the rear wheel and said roller drives said electrical generator.

12. The apparatus of claim 9 further comprising means for converting the output voltage of said electrical generator into a variable resistance for the computer interface.

13. The apparatus of claim 7 wherein said computer interface comprises a game port interface for a personal computer.

14. An apparatus for removably connecting a bicycle as a controller for an electronic game having a interface for receiving electrical signals, said bicycle having pedals, a rear wheel driven by said pedals, and handlebars; said apparatus comprising:

a rear wheel support having:

(a) a support for removably holding the bicycle in an upright position while allowing rotation of the rear wheel in response to force exerted on the pedals of the bicycle by a rider; and (b) a rear wheel sensor for interface to an electronic game, said rear wheel sensor detecting the rotational speed of the rear wheel of the bicycle; and a front wheel support;

a potentiometer interfaced to the electronic game and removably attachable to the bicycle; and a hand-grip lever to rotate the potentiometer, thereby providing a steering input to the electronic game.

15. The apparatus of claim 14 wherein the front support member further comprises a slot for removably engaging a lower portion of the front wheel of the bicycle.

16. The apparatus of claim 14 wherein said rear wheel sensor comprises an electrical generator driven by the rear wheel.

17. The apparatus of claim 16 wherein said rear wheel support further comprises a roller for contacting and supporting the rear wheel of the bicycle, and wherein said roller is rotated by the rear wheel and said roller drives said electrical generator.

18. The apparatus of claim 16 further comprising means for converting the output voltage of said electrical generator into a variable resistance for the electronic game interface.

19. The apparatus of claim 14 further comprising a control switch for removable attachment to the bicycle and for interface to the electronic game.

* * * * *